US012722093B2

(12) United States Patent
Goergen

(10) Patent No.: US 12,722,093 B2
(45) Date of Patent: Sep. 1, 2026

(54) SYSTEMS AND METHODS FOR OPERATING AN AMUSEMENT PARK SYSTEM

(71) Applicant: Universal City Studios LLC, Universal City, CA (US)

(72) Inventor: Patrick John Goergen, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 865 days.

(21) Appl. No.: 17/959,647

(22) Filed: Oct. 4, 2022

(65) Prior Publication Data

US 2024/0042341 A1 Feb. 8, 2024

Related U.S. Application Data

(60) Provisional application No. 63/394,750, filed on Aug. 3, 2022.

(51) Int. Cl.
*A63G 31/02* (2006.01)
*A63G 31/16* (2006.01)

(52) U.S. Cl.
CPC ..... *A63G 31/02* (2013.01); *A63G 31/16* (2013.01)

(58) Field of Classification Search
None
See application file for complete search history.

(56) References Cited

U.S. PATENT DOCUMENTS 8,132,513 B2 3/2012 Crawford et al.
9,463,391 B2 10/2016 Job et al.
9,889,860 B2 * 2/2018 Osterman ..... B60W 50/14
10,737,186 B2 * 8/2020 Morosini ..... A63G 3/02
12,133,134 B2 * 10/2024 Lugo ..... A63G 31/00
(Continued)

FOREIGN PATENT DOCUMENTS

CA 3168320 A1 * 9/2021 ..... G01S 13/88
CA 3168327 A1 * 9/2021 ..... A63G 33/00
WO WO-2018235465 A1 * 12/2018 ..... A63J 5/02

OTHER PUBLICATIONS

PCT/US2023/029235 International Search Report and Written Opinion mailed Nov. 23, 2023.

*Primary Examiner* — Magdalena Topolski
(74) *Attorney, Agent, or Firm* — Fletcher Yoder P.C.

(57) ABSTRACT

A controller for an amusement park attraction system includes processing circuitry and memory with instructions that, when executed by the processing circuitry, are configured to cause the processing circuitry to operate the amusement park attraction system in a primary mode, receive a plurality of operating parameter values of the amusement park attraction system during operation of the amusement park attraction system in the primary mode, compare the plurality of operating parameter values to respective, corresponding threshold ranges of values, determine an operating parameter value of the plurality of operating parameter values is outside of a corresponding threshold range of values in the primary mode, and transition operation of the amusement park attraction system from the primary mode to a secondary mode in response to determining the operating parameter value is outside of the corresponding threshold range of values in the primary mode.

18 Claims, 6 Drawing Sheets

(56) References Cited

U.S. PATENT DOCUMENTS

| | | | | |
|---|---|---|---|---|
| 2015/0161833 | A1 | 6/2015 | Smith | |
| 2016/0048203 | A1* | 2/2016 | Blum | G06F 3/013 104/84 |
| 2018/0253141 | A1 | 9/2018 | McCracken | |
| 2020/0223360 | A1 | 7/2020 | Bruno et al. | |
| 2021/0052991 | A1 | 2/2021 | Krauthamer | |
| 2021/0157004 | A1* | 5/2021 | Graham | G01S 7/4817 |
| 2021/0245067 | A1 | 8/2021 | Mugnier | |
| 2021/0268984 | A1 | 9/2021 | Krauthamer et al. | |
| 2023/0311011 | A1* | 10/2023 | Zebleckes | A63G 31/16 472/59 |

* cited by examiner

SYSTEMS AND METHODS FOR OPERATING AN AMUSEMENT PARK SYSTEM

CROSS-REFERENCE TO RELATED APPLICATION

This application claims priority to and the benefit of U.S. Provisional Application No. 63/394,750, entitled "SYSTEMS AND METHODS FOR OPERATING AN AMUSEMENT PARK SYSTEM," filed Aug. 3, 2022, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Throughout amusement parks and other entertainment venues, special effects can be used to help immerse guests in the experience of a ride or attraction. Immersive environments may include three-dimensional (3D) props and set pieces, robotic or mechanical elements, and/or display surfaces that present media. In addition, the immersive environment may include audio effects, smoke effects, and/or motion effects. Thus, immersive environments may include a combination of dynamic and static elements. However, implementation and operation of special effects may be complex. For example, it may be difficult to operate certain elements of the special effects in a desirable manner to create the immersive environment. With the increasing sophistication and complexity of modern ride attractions, and the corresponding increase in expectations among theme or amusement park guests, improved and more creative attractions are desirable, including ride attractions having special effects to provide a desirable experience.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, a controller for an amusement park attraction system includes processing circuitry and memory with instructions that, when executed by the processing circuitry, are configured to cause the processing circuitry to operate the amusement park attraction system in a primary mode, receive a plurality of operating parameter values of the amusement park attraction system during operation of the amusement park attraction system in the primary mode, compare the plurality of operating parameter values to respective, corresponding threshold ranges of values, determine an operating parameter value of the plurality of operating parameter values is outside of a corresponding threshold range of values in the primary mode, and transition operation of the amusement park attraction system from the primary mode to a secondary mode in response to determining the operating parameter value is outside of the corresponding threshold range of values in the primary mode.

In an embodiment, a non-transitory computer-readable medium comprising instructions that, when executed by processing circuitry, are configured to cause the processing circuitry to receive a plurality of operating parameter values of an amusement park system, operate the amusement park system in a primary mode in response to determining each operating parameter value of the plurality of operating parameter values is within a respective, corresponding threshold range of values, determine an operating parameter value of the plurality of operating parameter values is outside of a corresponding threshold range of values, select a secondary mode from a plurality of secondary modes based on the secondary mode being associated with the operating parameter value that is outside of the corresponding threshold range of values, and operate the amusement park system in the secondary mode.

In an embodiment, an amusement park system includes a prop, an actuator configured to drive movement of the prop and a controller communicatively coupled to the actuator. The controller is configured to receive a plurality of operating parameter values of the amusement park system, determine an operating parameter value of the plurality of operating parameter values is outside of a threshold range of values, determine the prop is associated with the operating parameter value that is outside of the threshold range of values, and operate the amusement park system in a secondary mode of a plurality of secondary modes, instead of in a primary mode, in response to determining the operating parameter value is outside of the threshold range of values.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
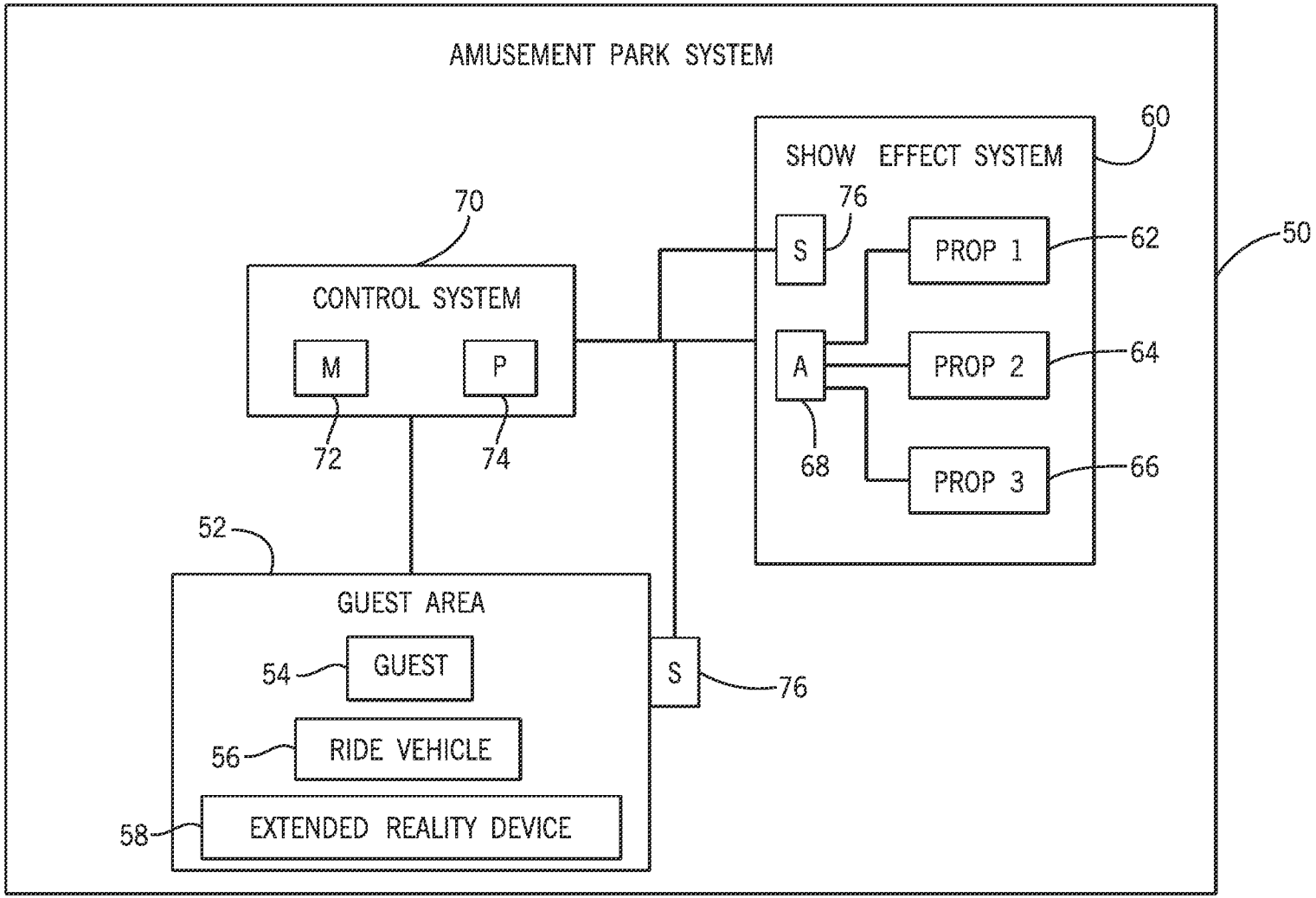
FIG. 1 is a block diagram of an embodiment of an amusement park system, in accordance with an aspect of the present disclosure.

When introducing elements of various embodiments of the present disclosure, the articles "a," "an," and "the" are intended to mean that there are one or more of the elements.

The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure are directed to a show effect system that may be used in conjunction with entertainment venues, such as an amusement park. The amusement park may include various attraction systems, such as a ride (e.g., a roller coaster, a water ride, a drop tower), a performance show, a walkway, and so forth, with features that may entertain guests at the amusement park. The amusement park may also include a show effect system configured to operate to present various effects, such as visual effects and/or audio effects, to the guests. For example, the show effect system may be a part of an attraction system and may present special effects to guests within the attraction system, such as guests within a ride vehicle of the attraction system, at a queue of the attraction system, in an auditorium of the attraction system, and the like. Additionally or alternatively, the show effect system may be external to any attraction system and may, for instance, present show effects to guests at a pathway, a dining area, a souvenir shop, and so forth of the amusement park. The show effect system may provide a desirable experience, such as an immersive environment, to the guests.

A control system may operate different aspects of an amusement park system. For example, the control system may control movement of a physical prop (e.g., an animated figure, lighting, a projector) of the show effect system. In an embodiment, the control system may receive data from various sensors and operate the show effect system based on the data. The data may indicate various operating parameter values, such as a positioning of the physical prop. In some circumstances, an operating parameter value may indicate an undesirable operation or condition, such as an undesirable positioning of the physical prop (e.g., caused by wear or faulty operation of the physical prop). Such an operating parameter value may indicate that an experience is no longer operating in a desired manner (e.g., within desired tolerances). For instance, the undesirable positioning of the physical prop may lessen the immersive environment established by the show effect system.

In one example, an attraction system may be arranged to permit guests to move within an environment and interact with or observe various prop elements that are activated based at least in part on the actions of a guest or a group of guests. These prop elements can operate based on machine learning models to provide responses that are not simply selected from a set of pre-programmed options, but that are dynamic responses appropriate for the real-world conditions of the environment. For example, if the guest interactions are associated with fast-paced action, the activated prop elements can respond accordingly. Further, the machine learning model can also incorporate operating boundaries that are based on the range of motion and variable speeds of each actuatable component of a prop, as well as on providing appropriate distances between the props and guests and/or between individual prop elements. Typically, actuatable props may be controlled in a top-down hierarchical manner in which the operating boundaries are static for all possible movement types and scenarios. For example, a robot arm can operate according to a maximum movement speed of 300 degrees/second. However, in the disclosed embodiments, the operating boundaries used by the machine learning model can be adjustable or dynamic based on other conditions, either of the attraction environment or of the prop itself.

For instance, rather than operating a robot arm with a speed selection between the available speeds of 0 and 300 degrees/second, the disclosed techniques adjust these boundaries based on whether the arm is moving in a particular direction, what other elements are near the robot arm, and/or a particular tenor or desired effect. For example, if the robot arm is employed as part of a jump scare effect, the desired speed for the effect can be set to the top of the available speeds. However, if these speeds are contraindicated based on other inputs to the model, then the system can make a real-time adjustment that both conforms to the limitations of the environment and retains the nature of the desired effect. Thus, instead of reducing the speed of the robot arm to fall within the appropriate operating boundaries, the system instead may actuate a different robot arm and/or an entirely different prop that is permitted to actuate at high speeds consistent with a jump scare effect.

Thus, it is presently recognized that compensating for or mitigating an undesirable operation or condition may improve the experience provided to the guests. Accordingly, embodiments of the present disclosure are directed to adjusting operation of an amusement park system in response to determining whether an operating parameter value is outside of a desired threshold. In an embodiment, a control system may compare multiple operating parameter values to respective, corresponding threshold ranges of values indicative of desirable operations. In response to determining that each operating parameter value is within its corresponding threshold range of values, the control system may operate the amusement park system in a primary mode. However, in response to determining that one of the operating parameter values is outside of its corresponding threshold range of values, the control system may operate the amusement park system in a secondary mode instead of the primary mode. In an embodiment, the control system may select a secondary mode from a plurality of secondary modes based on the operating parameter value that is outside of its corresponding threshold range of values and/or based on remaining operating parameter values that are within their corresponding threshold ranges of values. For example, the operating parameter value may be associated with movement of a first prop configured to provide a near contact condition with the ride vehicle.

The operating parameter value being outside of its corresponding threshold range of values may indicate that the first prop is not moving sufficiently within a threshold distance of a ride vehicle and therefore is not providing the near contact condition with the ride vehicle. In response, the control system may adjust movement of a second prop to provide a near contact condition between the second prop and the ride vehicle (e.g., a near contact condition that may not otherwise occur in the primary mode), thereby compensating for the undesirable movement control of the first prop. Indeed, the secondary mode effectuated by the control system may enable the amusement park system to continue to provide a desirable experience (e.g., a near contact condition) for the guests, even while a certain operation in the primary mode may be not be desirable.

With the preceding in mind, FIG. 1 is a schematic diagram of an amusement park system 50. As an example, the amusement park system 50 may be a part of an attraction system, such as a ride (e.g., a roller coaster, a dark ride), a performance show, and the like. As another example, the amusement park system 50 may be a part of a dining venue, a waiting area, a walkway, a shopping venue (e.g., a gift shop), or any other suitable part of an amusement park. The amusement park system 50 may include a guest area 52 where guests 54 may be located. For instance, the guest area 52 may include a ride vehicle 56, which may move and change its position, location, and/or orientation within the amusement park system 50. The guest area 52 may additionally, or alternatively, include a pathway that the guests 54, a queue, a seating area, a standing area, or any other suitable feature configured to accommodate the guests 54.

In one embodiment, each guest 54 may utilize an extended reality device 58 (e.g., an augmented reality (AR) device, a virtual reality (VR) device, a mixed reality (MR) device), such as a headset, a goggle, and the like. Each extended reality device 58 may present imagery or other digital objects (e.g., virtual elements). By way of example, the imagery presented by the extended reality device 58 may supplement or complement real world objects. For instance, the extended reality device 58 may present the digital objects in a manner with respect to (e.g., appearing to interact with) a real world object to provide an appearance that the digital object is a part of the real world environment. As such, the extended reality device 58 may further enhance the experience of the guests 54.

The amusement park system 50 may also include a show effect system 60, which may include or be separate from the extended reality device 58. The show effect system 60 may include various props that may be controlled to entertain the guests 54. For instance, a first prop 62, a second prop 64, and a third prop 66 may be moved via one or more actuators 68. Movement of the props 62, 64, 66 with respect to the guests 54 (e.g., with respect to the guest area 52, with respect to the ride vehicle 56) may provide a desirable experience for the guests 54. As an example, one of the props 62, 64, 66 may be moved adjacent to the guest 54 to provide an appearance of a near contact condition with the guest 54. As another example, the props 62, 64, 66 may be moved with respect to one another to provide a realistic environment in which the props 62, 64, 66 appear to be interacting with one another. As a further example, the props 62, 64, 66 may be moved to change visibility with respect to the guests 54 (e.g., to move into and/or out of view). In addition to, or as an alternative to, physical movement, the props 62, 64, 66 may include other aspects that are controllable during operation of the show effect system 60. For example, the props 62, 64, 66 may include a fluid directing machine (e.g., a fan, a fog machine, a sprayer) that may be operated to control output of fluid, a display projector that may be operated to control presentation of imagery, lighting that may be operated to control output of light (e.g., light intensity, light color), an audio output device (e.g., a speaker) that may be operated to control output of audio effects, a fragrance diffuser that may be operated to control output of a scent, another prop configured to provide any other suitable show effect, or any combination thereof.

The amusement park system 50 may include a control system 70 (e.g., an automation controller, a programmable controller, an electronic controller, control circuitry), which may be a part of or communicatively coupled to the show effect system 60. The control system 70 may have a memory 72, which may include volatile memory, such as random access memory (RAM), and/or non-volatile memory, such as read-only memory (ROM), optical drives, hard disc drives, solid-state drives, or any other non-transitory computer-readable medium that includes instructions to operate the attraction system 50. The processing circuitry 74 may be configured to execute such instructions. For example, the processing circuitry 74 may include one or more application specific integrated circuits (ASICs), one or more field programmable gate arrays (FPGAs), one or more general purpose processors, or any combination thereof. The control system 70 may operate various components of the show effect system 60.

For example, the control system 70 may operate the actuators 68 to control movement of the props 62, 64, 66. The control system 70 may additionally, or alternatively, operate the extended reality device 58 to control the imagery presented to the guests 54. In an embodiment, the control system 70 may be communicatively coupled to various sensors 76 and may receive data from the sensors 76. The control system 70 may operate the show effect system 60 based on the received data. Such data may be indicative of various operating parameters values associated with the guest area 52 and/or the show effect system 60. As an example, the data may indicate a position of the guests 54 (e.g., the ride vehicle 56) with respect to the show effect system 60, and the control system 70 may operate the show effect system 60 based on the position of the guests 54, such as to move the props 62, 64, 66 via the actuators 68 in response to a determination that the guests 54 are within a threshold distance of the show effect system 60. As another example, the data may indicate a position of the props 62, 64, 66, and the control system 70 may operate the show effect system 60 based on the position of the props 62, 64, 66, such as to move the props 62, 64, 66 relative to one another and/or to the guest area 52 to position the props 62, 64, 66 within a threshold range of distances with respect to one another and/or to the guest area 52. As a further example, the data may indicate a time of operation of the amusement park system 50, and the control system 70 may operate the show effect system 60 at specific time stamps based on the time of operation.

The control system 70 may additionally, or alternatively, operate the ride vehicle 56 based on the data received from the sensors 76. For example, the control system 70 may control movement of the ride vehicle 56, such as along a path, based on the data. Controlling movement of the ride vehicle 56 may control an experience provided by the guests 54 via the show effect system 60. For instance, a distance between the ride vehicle 56 and the show effect system 60 may be adjusted via movement of the ride vehicle 56 to adjust a distance between the guests 54 and one of the props 62, 64, 66, visibility of one of the props 62, 64, 66 to the guests 54, and the like.

The control system 70 may further determine whether the data received from the sensors 76 indicate a desirable operation of the amusement park system 50. To this end, the control system 70 may compare each operating parameter value indicated by the data with a respective, corresponding threshold range of values indicative of a desirable operation. In response to determining that each operating parameter value is within the respective, corresponding threshold range of values, the control system 70 may determine that the amusement park system 50 is operating as desired. The control system 70 may then continue operation of the amusement park system 50, such as in a primary mode. However, in response to determining that one or more of the operating parameter values are outside of (e.g., above, below) the respective, corresponding threshold range of values, the control system 70 may determine that the amusement park system 50 is not operating as desired. The control system 70 may then adjust operation of the amusement park system 50, such as of the show effect system 60. For example, the control system 70 may adjust operation of the amusement park system 50 from the primary mode to one of a plurality of secondary modes. The control system may select a particular secondary mode for operation based on the operating parameter values, such as based on the operating parameter value(s) that are outside of the respective, corresponding threshold range(s) of values and/or based on the operating parameter value(s) that are within the respective, corresponding threshold range(s) of values.

For this reason, the sensors 76 may include a variety of different types of sensors to provide different types of data to the control system 70 and enable the control system 70 to better operate the amusement park system 50, such as to accurately determine whether the operation of the amusement park system 50 is desirable and/or to select a more suitable secondary mode for operation. By way of example, the sensors 76 may include an optical sensor (e.g., a camera, an infrared sensor, a light detection and ranging sensor, a proximity sensor), a position sensor (e.g., a gyroscope, an inertial measurement unit, a global positioning system), a vibration sensor (e.g., an accelerometer, a vibration meter), a force sensor (e.g., a load cell), a deformation sensor (e.g., a strain gauge), a pressure sensor (e.g., a gauge pressure sensor), a power sensor (e.g., a current sensor, a voltage sensor), another suitable sensor, or any combination thereof. The control system 70 may utilize data received from any of such sensors 76 to determine whether the operation of the amusement park system 50 is desirable, such as to determine whether operation of the actuators 68 position the props 62, 64, 66 at desirable positionings.

In certain embodiments, the respective, corresponding threshold range(s) of values to which the operating parameter value(s) are compared may be dynamically adjusted and/or selected. For example, the respective, corresponding threshold range(s) of values may be different for different modes (e.g., different for the primary mode and/or each secondary mode), different operations of components (e.g., of the ride vehicle 56, of the extended reality device 58, of the props 62, 64, 66), different times or cycles of operation of the amusement park system 50, and so forth. Indeed, the control system 70 may determine initial operating parameter(s) of the amusement park system 50, select a particular threshold range of values based on the initial operating parameter(s), and compare subsequently received operating parameter(s) to the selected particular threshold range of values to more suitably determine whether a current operation of the amusement park system 50 is desirable or is to be adjusted, such as to one of the secondary modes.

Figure 2:
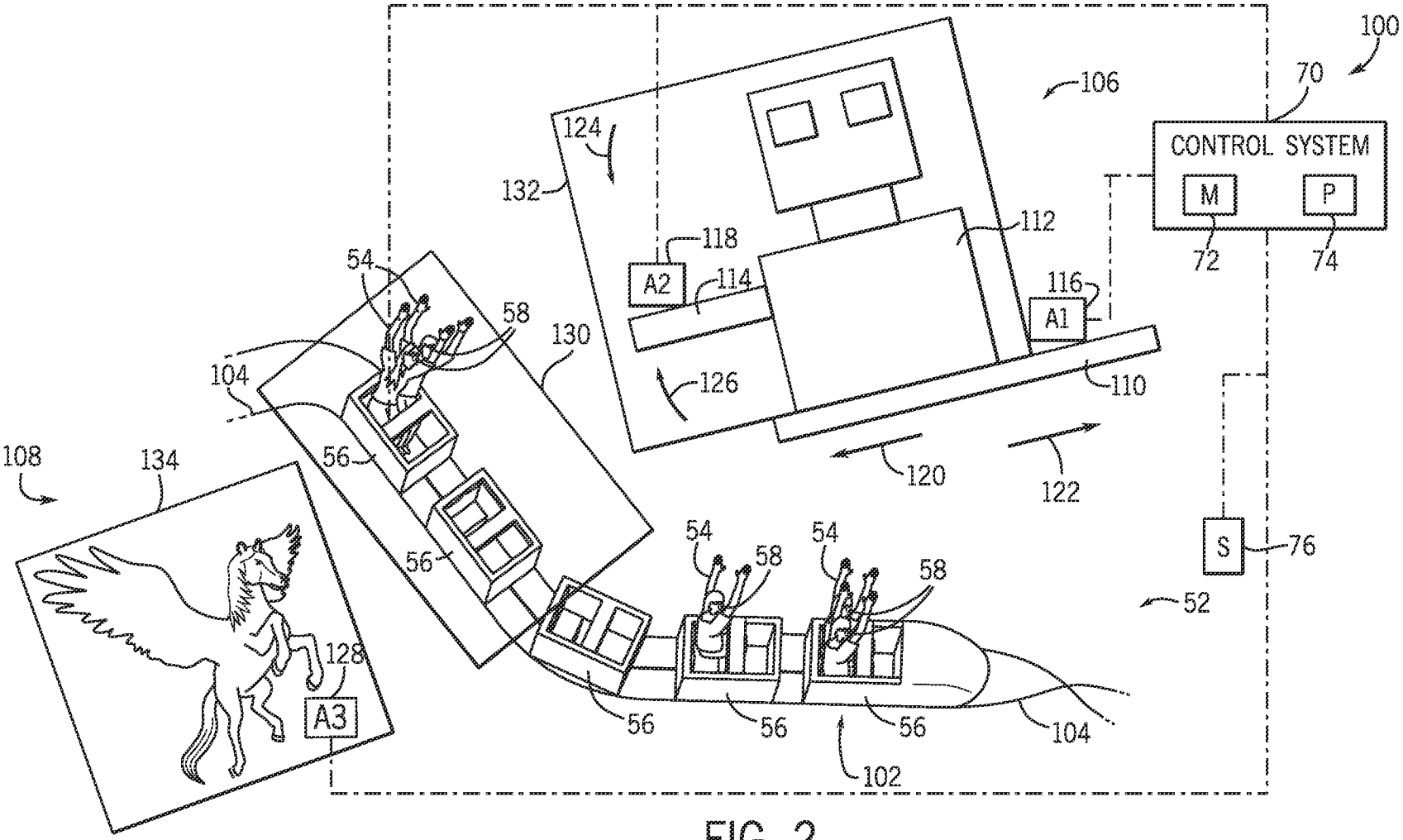
FIG. 2 is a schematic diagram of an attraction system for an amusement park, in accordance with an aspect of the present disclosure.

FIG. 2 is a schematic view of an embodiment of an attraction system 100 for an amusement park. For example, the attraction system 100 may be a part of the amusement park system 50 of FIG. 1. In the illustrated embodiment, the guest area 52 of attraction system 100 includes a ride 102 (e.g., a roller coaster), which may include multiple, individual ride vehicles 56 coupled to one another (e.g., via a link) and configured to travel along a path or track 104. The path 104 may guide the movement (e.g., direction, speed, orientation) of the ride vehicles 56 through the attraction system 100. In an additional or alternative embodiment, the path 104 may be an open surface along which the ride vehicles 56 may generally travel (e.g., guided based on user input or controller input).

The guests 54 may be positioned in the ride vehicles 56 such that the ride vehicles 56 may carry the guests 54 through the attraction system 100. Additionally, the guests 54 may possess extended reality devices 58, which are shown as goggles in the illustrated embodiment. During operation of the attraction system 100, the extended reality devices 58 may present imagery to entertain the guests 54. For example, the imagery presented by the extended reality devices 58 may provide an immersive environment (e.g., a virtual reality environment) within the attraction system 100, such as an immersive environment through which the guests 54 appear to move via movement of the ride vehicles 56 along the path 104. Thus, the imagery presented by the extended reality devices 58 and the movement of the ride vehicles 56 may cooperatively entertain the guests 54.

The attraction system 100 may also include a first prop 106 (e.g., a first animated figure) and a second prop 108 (e.g., a second animated figure). Each of the first prop 106 and the second prop 108 may be movable with respect to the guests 54, such as with respect to the ride vehicles 56 and/or with respect to the path 104. As an example, the first prop 106 may include a base 110 (e.g., a rail), a body 112 (e.g., a torso) coupled to the base 110, and an extension 114 (e.g., an arm) coupled to the body 112. A first actuator 116 may operate to move (e.g., translate) the body 112 along the base 110, such as in a first direction 120 toward the path 104 and in a second direction 122, opposite the first direction 120, away from the path 104. A second actuator 118 may operate to move (e.g., translate, rotate) the extension 114 relative to the body 112. For instance, the second actuator 118 may rotate the extension 114 in a first rotational direction 124 toward the path 104 and in a second rotational direction 126, opposite the first rotational direction 124, away from the path 104. Additionally or alternatively, the second actuator 118 may extend or retract (e.g., linearly extend, linearly retract) the extension 114 with respect to the body 112 to move the extension 114 toward or away from, respectively, the path 104. A third actuator 128 may move the second prop 108. For example, the third actuator 128 may also move the second prop 108 toward or away from the path 104. Additionally or alternatively, the third actuator 128 may cause different movement of the second prop 108, such as movement of a portion of the second prop 108 (e.g., relative to a remainder of the second prop 108) instead of an entirety of the second prop 108 with respect to the path 104.

The control system 70 may be communicatively coupled to the actuators 116, 118, 128 to move either of the props 106, 108. In an embodiment, in a primary mode of the attraction system 100, the control system 70 may control the actuators 116, 118, 128 to move the first prop 106 (e.g., the body 112 along the base 110, the extension 114 relative to the body 112) and/or the second prop 108 to pre-set (e.g., pre-determined) positionings. By way of example, the control system 70 may cause the first prop 106 (e.g., the extension 114) and/or the second prop 108 to move to within a threshold distance of the ride vehicles 56. However, in response to determining that an operating parameter value (e.g., as indicated via data received from a sensor 76) is outside of a threshold range of values, the control system 70 may operate the attraction system 100 in a secondary mode. For example, a faulty operation, undesirable installation, adjusted structural integrity (e.g., wearing), and so forth of any of the components (e.g., of one of the props 106, 108, of one of the actuators 116, 118, 128, of the ride vehicles 56) may cause the operating parameter value to be outside of the threshold range of values. The control system 70 may adjust operation of the attraction system 100 from the primary mode to the secondary mode to provide a desirable experience for guests instead of, for example, suspending operation of the attraction system 100 and/or continuing operation of the attraction system 100 in the primary mode to provide an undesirable experience to the guests 54.

In an example, the control system 70 may determine the distance between the ride vehicles 56, the first prop 106, and/or the second prop 108 to operate the attraction system 100 accordingly. For instance, the ride vehicles 56 may be associated with a first boundary 130, which may indicate a space occupied by the ride vehicles 56, such as an enlarged volume or bubble encompassing the periphery of the ride vehicles 56 and an adjacent area to accommodate additional leeway or tolerance. The first prop 106 may be associated with a second boundary 132 indicating a space occupied by the first prop 106, and the second prop 108 may be associated with a third boundary 134 indicating a space occupied by the second prop 108. In an embodiment, the boundaries 132, 134 may reflect a current state of the props 106, 108. The control system 70 may determine the respective boundaries 130, 132, 134 during operation of the attraction system 100. For example, the control system 70 may determine the boundaries 130, 132, 134 based on the data received from the sensors 76, such as data (e.g., optical data, movement data, position data, stress analysis, time of operation) indicative of the positioning of the ride vehicles 56, of the first prop 106, and/or of the second prop 108.

In an embodiment, the control system 70 may dynamically determine the boundaries 130, 132, 134. For instance, as the ride vehicles 56, the first prop 106, and/or the second prop 108 move relative to one another, the control system 70 may determine updated boundaries 130, 132, 134 based on the updated positioning of the ride vehicles 56, the first prop 106, and/or the second prop 108. For instance, the boundaries 130, 132, 134 may be defined (e.g., predetermined or pre-set based on a user input) for the ride vehicles 56, the first prop 106, and/or the second prop 108, respectively, the control system 70 may determine the locations of the ride vehicles 56, the first prop 106, and/or the second prop 108 based on data received from the sensors 76, and the control system 70 may determine the location of the boundaries 130, 132, 134 based on the determined locations. A size, shape, a profile, or other characteristic of the boundaries 130, 132, 134 may also be determined based on a configuration of the ride vehicles 56, of the first prop 106, and/or of the second prop 108. By way of example, movement of the extension 114 toward or away from the body 112 may reduce or increase, respectively, a geometry of the second boundary 132. Furthermore, a parameter, such as a movement, a quantity, and/or a size (e.g., height), of the guests 54 within the ride vehicles 56 may adjust the configuration of the first boundary 130. Further still, dynamic stress and/or fatigues of different portions of the attraction system 100 may be performed to determine the boundaries 130, 132, 134. For instance, respective fatigue analyses of the base 110, the body 112, and/or the extension 114 may be performed (e.g., based on data received from the sensors 76) and collectively used to determine the second boundary 132. That is, the fatigue analysis of multiple, individual portions of a component may be used to determine an overall boundary, thereby determining the boundary over time of usage of the attraction system 100. By dynamically calculating the boundaries 130, 132, 134 during operation of the attraction system 100, the determined boundaries 130, 132, 134 may more closely represent the space occupied by the ride vehicles 56, the first prop 106, and/or the second prop 108.

The control system 70 may determine a distance between the ride vehicles 56 and the props 106, 108 based on the boundaries 130, 132, 134. In an example, the control system 70 may determine that a distance between the ride vehicles 56 and the first prop 106 (e.g., the extension 114) may be below a threshold range of distances in response to a determination that the first boundary 130 and the second boundary 132 overlap with one another. For instance, operation of the first actuator 116 may cause the body 112 and/or the extension 114 to move undesirably close to the ride vehicles 56, and/or movement of the ride vehicles 56 along the path 104 may move the ride vehicles 56 in close proximity to the body 112 and/or to the extension 114. In response to determining that the first boundary 130 and the second boundary 132 overlap with one another, the control system 70 may operate the attraction system 100 in a secondary mode to increase the distance between the ride vehicles 56 and the first prop 106 and avoid potential contact between the ride vehicles 56 and the first prop 106. By way of example, the control system 70 may reduce or suspend (e.g., with respect to typical operation during the primary mode) operation of the first actuator 116 to reduce movement of the first prop 106 in the first direction 120. The control system 70 may additionally, or alternatively, reduce or suspend operation of the second actuator 118 to reduce movement of the extension 114 in the first rotational direction 124. Further still, the control system 70 may adjust movement of the ride vehicles 56 along the path 104. For instance, the control system 70 may cause the ride vehicles 56 to move along a separate portion of the path 104 and/or may move the path 104 altogether to move the ride vehicles 56 away from the first prop 106, thereby increasing the distance between the first boundary 130 and the second boundary 132 (e.g., above a threshold distance). The control system 70 may similarly operate the attraction system 100 to maintain the first boundary 130 of the ride vehicles 56 and the third boundary 134 of the second prop 108 above a threshold distance.

In another example, the control system 70 may determine that a distance between the ride vehicles 56 and the first prop 106, such as a between the first boundary 130 and the second boundary 132, may be above a threshold range of distances. For instance, communication between the control system 70 and one of the first actuator 116 and the second actuator 118 may be interrupted. As a result, certain movement of the first prop 106 may be limited. As an example, the appearance that the first prop 106 is coming toward contact with the ride vehicle 56 may be diminished, the first prop 106 may not provide a realistic interaction (e.g., with the second prop 108), and/or a portion of the first prop 106 may not be visible to the guests 54. In this manner, the first prop 106 may not adequately contribute to providing the desirable experience to the guest 54.

In response, the control system 70 may adjust operation of the attraction system 100 to a secondary mode to compensate for the undesirable operation of the first prop 106. As an example, the control system 70 may adjust operation of the second prop 108, such as by changing the positioning of the second prop 108 (e.g., to move the second prop 108 toward the area where the first prop 106 may be typically positioned in the primary mode) and/or adjusting movement of the second prop 108 toward the ride vehicles 56 (e.g., to reduce the distance between the first boundary 130 and the third boundary 134 below a typical distance associated with the primary mode). As such, operation of the second prop 108 may fulfill functions or provide similar show effects that would typically be provided by the first prop 106 in the primary mode. In such an example, the control system 70 may adjust a threshold range of distances (e.g., relative to the ride vehicles 56) associated with the second prop 108 to determine whether the second prop 108 is operating as desired in the secondary mode. For example, the threshold range of distances associated with the second prop 108 in the secondary mode may be relatively closer to the ride vehicles 56 than the threshold range of distances associated with the second prop 108 in the primary mode, because the second prop 108 is to be moved closer to the ride vehicles 56 in the secondary mode than in the primary mode. In this manner, the threshold range of distances may be dynamically adjusted and updated to provide desirable operation of the props 106, 108 in different modes.

As another example, the control system 70 may provide additional show effects that may not be typically presented. For instance, because the first prop 106 may no longer hold the attention of the guests 54, the control system 70 may cause presentation of additional show effects, which may include visual effects (e.g., lighting, fog, imagery), sound effects, and the like, to entertain the guests 54. For example, the control system 70 may cause the extended reality devices 58 to present imagery that appears to be at the location of the attraction system 100 where the first prop 106 may typically be positioned in the primary mode. As another example, the control system 70 may adjust operation of the ride vehicles 56 and/or the path 104, such as by causing the ride vehicles 56 to move along a different part of the path 104 and/or by moving the path 104. Such adjusted operation of the ride vehicles 56 and/or the path 104 may move the ride vehicles 56 toward the first prop 106 and reduce the distance between the first boundary 130 and the second boundary 132 (e.g., to within the threshold range of distances). The control system 70 may similarly operate the attraction system 100 in a secondary mode based on an undesirable operation of the second prop 108 and/or the ride vehicles 56 to mitigate the undesirable operation.

Although the props 106, 108 are implemented in the attraction system 100 having the ride 102 in the illustrated embodiment, the props 106, 108 or similar props may be utilized in a different type of ride (e.g., a ride, such as a motion simulator, having a ride vehicle that does not travel along a path), a different type of attraction system (e.g., an attraction system without a ride vehicle), and/or an area of the amusement park external to any attraction system. Furthermore, different types of props, such as a display, a projector, a fog machine, a speaker, and so forth, may be utilized in any of such systems. In such implementations, the control system 70 may be configured to operate, such as in a particular secondary mode, using similar techniques described herein.

Each of FIGS. 3-6 described below illustrates a respective method or process associated with various operations, such as of the amusement park system 50, the show effect system 60, and/or the attraction system 100. In an embodiment, each of the methods may be performed by a single respective component or system, such as by the control system 70 (e.g., the processing circuitry 74). In an additional or alternative embodiment, multiple components or systems may perform the operations for a single one of the methods. It should also be noted that additional operations may be performed with respect to the described methods. Moreover, certain operations of the depicted methods may be removed, modified, and/or performed in a different order. Further still, the operations of any of the respective methods may be performed in parallel with one another, such at the same time and/or in response to one another.

Figure 3:
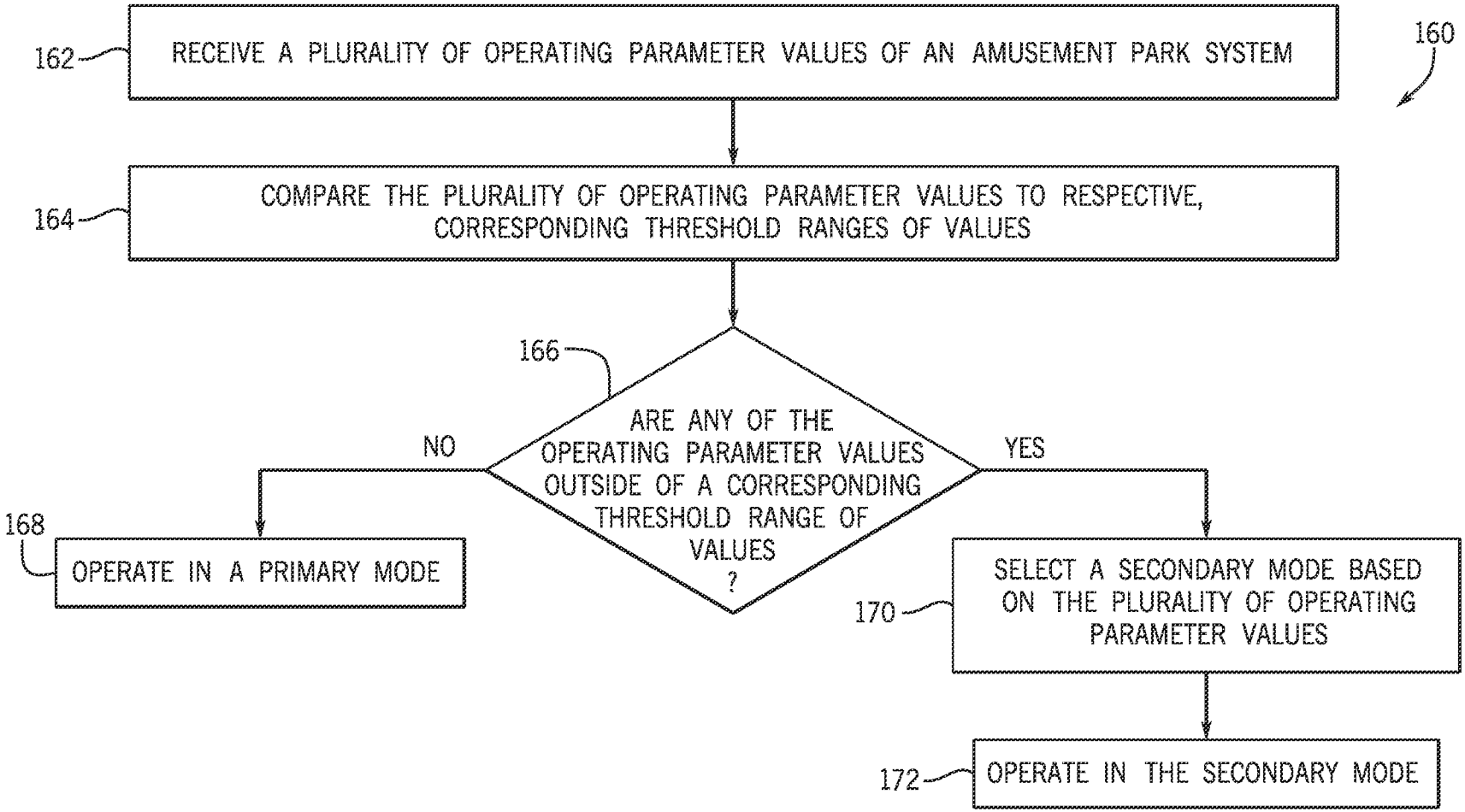
FIG. 3 is a flowchart of a method for operating a show effect system based on operating parameter values, in accordance with an aspect of the present disclosure.

FIG. 3 is a flowchart of an embodiment of a method 160 for operating an amusement park system. At block 162, a plurality of operating parameter values of an amusement park system may be received. The operating parameter values may be received as data from sensors. Additionally, the operating parameter values may be indicative of a variety of different information, such as positioning information, deformation information, force or stress information, communication information (e.g., signals received from a communicatively coupled component), and/or any other suitable type of information. The diversity of operating parameter values may be used to determine a state or condition of different aspects of the amusement park system, such as whether the amusement park system is operating desirably, which component of the amusement park system may not be operating desirably, an extent in which a component of the amusement park system may not be operating desirably, and/or a manner in which a component of the amusement park system may not be operating desirably. For instance, based on the operating parameter values, a determination may be made regarding whether to adjust operation of the amusement park system from previous cycles of operation or from a mode (e.g., a primary mode) that may be typically implemented while the operating parameter values are desirable.

To this end, at block 164, the operating parameter values may be compared to respective, corresponding threshold ranges of values. For example, each operating parameter value may be associated with a corresponding threshold range of values that may indicate desirable operation of the amusement park system. Thus, each operating parameter value may be compared with its corresponding threshold range of values to determine whether the operating condition of the amusement park system is desirable. For example, at block 166, a determination may be made regarding whether any of the operating parameter values are outside of its corresponding threshold range of values.

At block 168, in response to determining that none of the operating parameter values are outside of its corresponding threshold range of values, thereby indicating that a current operating condition of the amusement park system may be desirable, the amusement park system may be operated in a primary mode. The primary mode may be a mode that is implemented during a desirable operating condition of the amusement park system to provide a desirable experience to guests. For example, in the primary mode, certain signals may be output to control various props (e.g., to move with respect to the guests, to output various special effects) to provide a target experience. In an embodiment, the amusement park system may operate in the primary mode so long as each of the operating parameter values remains within the respective threshold range of values. That is, the signals that are output in the primary mode to control the amusement park system may not be adjusted until one of the operating parameter values is outside of its corresponding threshold range of values.

Thus, at block 170, in response to determining that one of the operating parameter values is outside of its corresponding threshold range of values, a secondary mode. The signals being output for each secondary mode may be different from the signals output in the primary mode. For instance, a prop may be controlled in a different manner (e.g., to move to a different position, to output a special effect in a different way) via the signals output in a particular secondary mode as compared to control of the prop in the primary mode. In one embodiment, the secondary mode may be selected based on the particular operating parameter value that is outside of its corresponding threshold range of values. For example, the operating parameter value that is outside of its corresponding threshold range of values may indicate an undesirable operation of one of the props, which may result in a reduced special effect to diminish the experience provided to the guests. In response, the secondary mode may be selected to compensate for the undesirable operation of the prop, such as to adjust operation of another prop to maintain the experience provided to the guests. In an additional or alternative embodiment, the secondary mode may be selected based on the operating parameter values that remain within the corresponding threshold range of values. As an example, the operating parameter values that remain within the threshold range of values may indicate which prop may be adjusted in operation. Thus, the secondary mode may be selected to control one of such props to mitigate effects associated with the operating parameter value that is outside of its corresponding threshold range of values. At block 172, the amusement park system may be operated in the selected secondary mode. That is, the signals that are typically output to operate the amusement park system in the primary mode may be adjusted to operate the amusement park system in the selected secondary mode.

The method 160 may also be performed to adjust secondary modes. For example, while operating in a first secondary mode, an additional operating parameter value may be determined to be outside of its corresponding threshold range of values. In response, a second secondary mode may be selected and implemented, such as based on the additional operating parameter value. In other words, the amusement park system may be operated in the first secondary mode for a first period of time while the additional operating parameter value is within the corresponding threshold range of values (e.g., the same threshold range of values as that of the primary mode or a different threshold range of values as that of the primary mode). However, after determining the additional operating parameter value is outside of the corresponding threshold range of values in the first secondary mode, operation of the amusement park system may be adjusted from the first secondary mode to the second secondary mode, and the amusement park system may be operated in the second secondary mode for a second period of time. The secondary modes may further be adjusted from different secondary modes in response to other operating parameter values being outside of threshold ranges of values (e.g., for operation in subsequent periods of time), such as threshold ranges of values that are dynamically updated based on a newly selected secondary mode. The secondary mode may be dynamic and responsive to changes in the environment (e.g., based on sensor signals).

Multiple secondary modes may also be selected and concurrently (e.g., in parallel, simultaneously) operated based on the plurality of operating parameter values. For example, in response to determining that multiple operating parameter values are outside of their corresponding threshold range of values, a respective, corresponding secondary mode may be in operation. In such embodiments, the secondary modes may be sequentially initiated. That is, for instance, a first secondary mode may be initiated in response to determining that a first operating parameter value is outside of a first threshold range of values corresponding to the first operating parameter value. While the first secondary mode is in operation, a determination may be made that a second operating parameter value is outside of a second threshold range of values corresponding to the second operating parameter value. In response, a second secondary mode may be initiated and implemented, and the first secondary mode may continue to be operated while the second secondary mode is in operation.

In some embodiments, the amusement park system may also transition operation from a secondary mode to the primary mode. For example, during operation in a secondary mode, a determination may be made that the operating parameter values are within the respective, threshold ranges of values corresponding to the primary mode, such as upon performance of a maintenance operation. In response, the amusement park system may be operated in the primary mode, and the method 160 may then be performed to determine whether operation of the amusement park system in the primary mode is to be maintained.

It should also be noted that the method 160 may be performed in response to an interruption in receiving an operating parameter value (e.g., during an interruption in communication with a sensor). In such an embodiment, instead of comparing the operating parameter value with a corresponding threshold range of values, a secondary mode may be directly selected. That is, a suitable secondary mode may be selected in response to determining an absence of receipt of an operating parameter value (e.g., within a threshold period of time after a previously received operating parameter value). The selected secondary mode may include an operation that accommodates for an upper limit or lower limit operation associated with the operating parameter value. By way example, for an operating parameter value indicative of a positioning of a prop, the secondary mode may adjust for a circumstance in which the prop is located most proximate to the ride vehicle to enable operation in a secondary mode that increases a distance between the ride vehicle and the prop. For an operating parameter value indicative of an amount of light being emitted by a component, the secondary mode may adjust for a circumstance in which no light is emitted by the component to enable operation in a secondary mode that provides illumination that would otherwise be emitted by the component.

In embodiments in which different operations of the method 160 may be performed in parallel with one another, the mode of the amusement park system may be adjusted based on separate comparisons between the operating parameter values and different threshold ranges of values corresponding to different modes. For example, a first comparison between the operating parameter values and a first threshold range of values corresponding to the primary mode may be made. Concurrently, a second comparison between the operating parameter values and a second threshold range of values corresponding to a secondary mode may be made. So long as the operating parameter values are within the first threshold range of values, the amusement park system may be operated in the primary mode. However, in response to a determination that the operating parameter values are outside of the first threshold range of values but are within the second threshold range of values, the amusement park system may be operated in the secondary mode.

In this way, operation of the amusement park system may be more readily adjusted, such as with reduced latency, based on concurrent comparisons between the operating parameter values and different threshold ranges of values.

Various operations to select and operate a secondary mode (e.g., from a plurality of secondary modes) are described herein. As an example, a model (e.g., stored in a memory) may define each secondary mode and associate each secondary mode with a particular undesirable operating condition of the amusement park system. For instance, the model may associate each secondary mode with a particular operating parameter value being outside of its corresponding threshold range of values and/or particular operating parameter values being within their corresponding threshold range of values. The model may be referenced during operation of the amusement park system, and a secondary mode may be selected based on the secondary mode being associated with an operating parameter value that is outside of its corresponding threshold range of values in accordance with the model.

However, it should be noted that the model may also be dynamically adjusted during operation of the amusement park system. By way of example, in response to determining a first operating parameter value is outside of a first threshold range of values, a first secondary mode may be selected and implemented. However, as a result of operation of a first secondary mode, a second operating parameter value (e.g., an operating parameter value that was originally within its corresponding threshold range of values in the primary mode) may be determined to be outside of a second threshold range of values. That is, the first secondary mode may not provide desirable operation of the amusement park system. In response, instead of continuing operation in the first secondary mode, as originally defined by the model, a second secondary mode may be selected and implemented. During operation of the second secondary mode, a determination may be made that the second operating parameter value is within the second threshold range of values and that remaining operating parameter values are within their corresponding threshold ranges of values, thereby indicating the second secondary mode is suitable for the current condition of the amusement park system. For this reason, the model may be adjusted to indicate that the second secondary mode is to be utilized instead of the first secondary mode in such circumstances (e.g., in subsequent operations in which the first operating parameter value is similarly outside of the first threshold range of values).

It should be noted that the secondary modes discussed herein are merely examples, and other techniques for operation of a particular secondary mode may be implemented in an additional or alternative embodiment. Indeed, other types of secondary modes may be operated, and/or other techniques for selecting one of the secondary modes for operation may be implemented.

Figure 4:
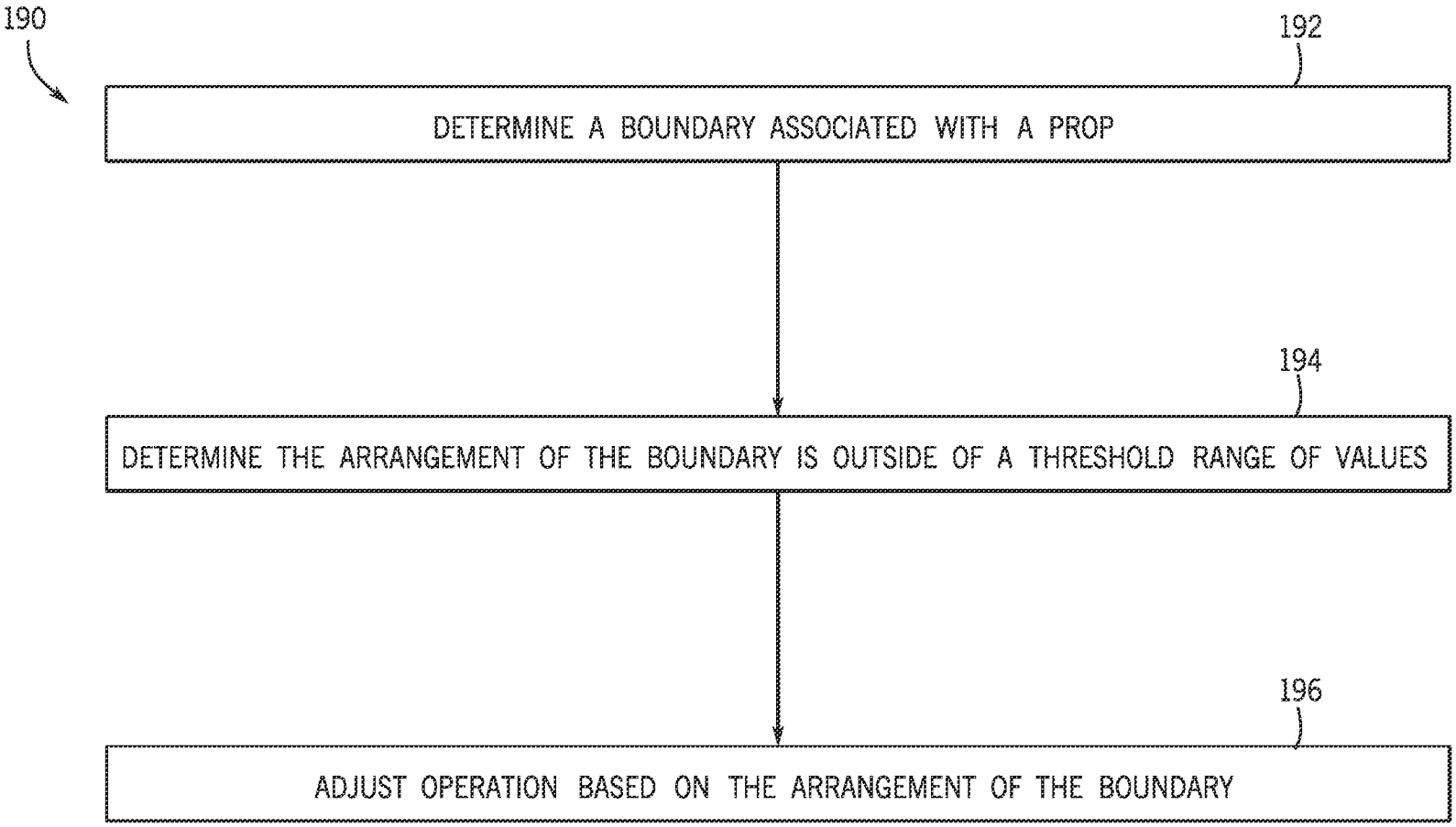
FIG. 4 is a flowchart of a method for adjusting operation of an amusement park system based on operating parameter values, in accordance with an aspect of the present disclosure.

FIG. 4 is a flowchart of a method 190 for adjusting operation of an amusement park system. At block 192, a boundary of a prop is determined. As an example, a shape and/or size of the boundary may be determined based on a configuration of the prop, such as an orientation of different portions of the prop. As another example, a positioning of the boundary may be determined. For instance, the positioning of the prop may be determined, and the positioning of the boundary may be determined based on the positioning of the prop. In either case, the boundary associated with the prop may be determined based on data received from a sensor, such as an optical sensor and/or a position sensor. In an embodiment, the boundary may include a set of coordinate points in a coordinate system representing a space within the amusement park system.

At block 194, an arrangement (e.g., a size, a shape, a location, an orientation) of the boundary is determined to be outside of a threshold range of values, which may include a threshold range of coordinate points in the coordinate system representing the space within the amusement park system. By way of example, the threshold range of values may indicate a range of positionings around a target positioning of the prop, such as a positioning effectuated via desirable actuation of the prop. A determination that the arrangement of the boundary is outside of the threshold range of values may therefore indicate the prop is not being desirably actuated. Additionally or alternatively, the threshold range of values may indicate a relative positioning of the prop with respect to another boundary, such as of another prop, a ride vehicle, and/or any other component of the amusement park system. The arrangement of the boundary being outside of such a threshold range of values may indicate undesirable positioning of the prop with respect to the other boundary, such as that the prop is positioned too close or too far from the other component (e.g., a threshold distance between the boundary and the other boundary is above or below a threshold distance).

At block 196, operation of the amusement park system may be adjusted based on the arrangement of the boundary that is outside of the threshold range of values. That is, the amusement park system may operate in a secondary mode (e.g., instead of a primary mode) that may mitigate or compensate for the undesirable arrangement of the boundary. The particular secondary mode may be selected based on the arrangement of the boundary relative to the threshold range of values.

As an example, in response to determining a distance between the boundary associated with a prop and a boundary associated with a ride vehicle is below a threshold distance, movement of the ride vehicle may be adjusted, such as by causing the ride vehicle to move to a different portion of a path, and/or movement of the prop may be reduced (e.g., suspended). In this manner, the distance between the boundary associated with the prop and the boundary associated with the ride vehicle may be increased above the threshold distance.

As another example, in response to determining the distance between the boundary associated with the prop and the boundary associated with the ride vehicle is above a threshold distance, movement of the ride vehicle may be adjusted, such as by causing the ride vehicle to move to a different portion of the path, and/or movement of the prop may be increased to reduce the distance between the boundary associated with the prop and the boundary associated with the ride vehicle below the threshold distance. Another adjustment to the operation of the amusement park system may be additionally, or alternatively, performed, such as in response to determining that the distance between the boundaries remains above the threshold distance upon adjusting operation of the amusement park system. For instance, movement of another prop may be adjusted, such as to reduce the distance between the other prop (e.g., the boundary of the other prop) and the ride vehicle (e.g., the boundary of the ride vehicle), an additional show effect (e.g., a fog effect, a lighting effect, a sound effect) may be presented, digital imagery may be presented to appear to interact with the prop that is in undesirable operation, another suitable action may be performed, or any combination thereof. Performance of the other action may divert the attention of guests, thereby providing entertainment to the guests in a manner that compensates for the undesirable operation of the prop.

As a further example, in response to determining the arrangement of the boundary indicates the prop is outside of a target location or position, the operation of the amusement park system may be adjusted to position a different element in the target location. For instance, another prop that may typically be at a different location may instead be moved to the target location associated with the prop. Additionally or alternatively, a digital object (e.g., imagery presented by a display, imagery presented by a projector, imagery presented by an extended reality device) may be presented at the location. In this manner, the target location may continue to be utilized in the secondary mode, even though the prop is not property being moved to the target location.

Figure 5:
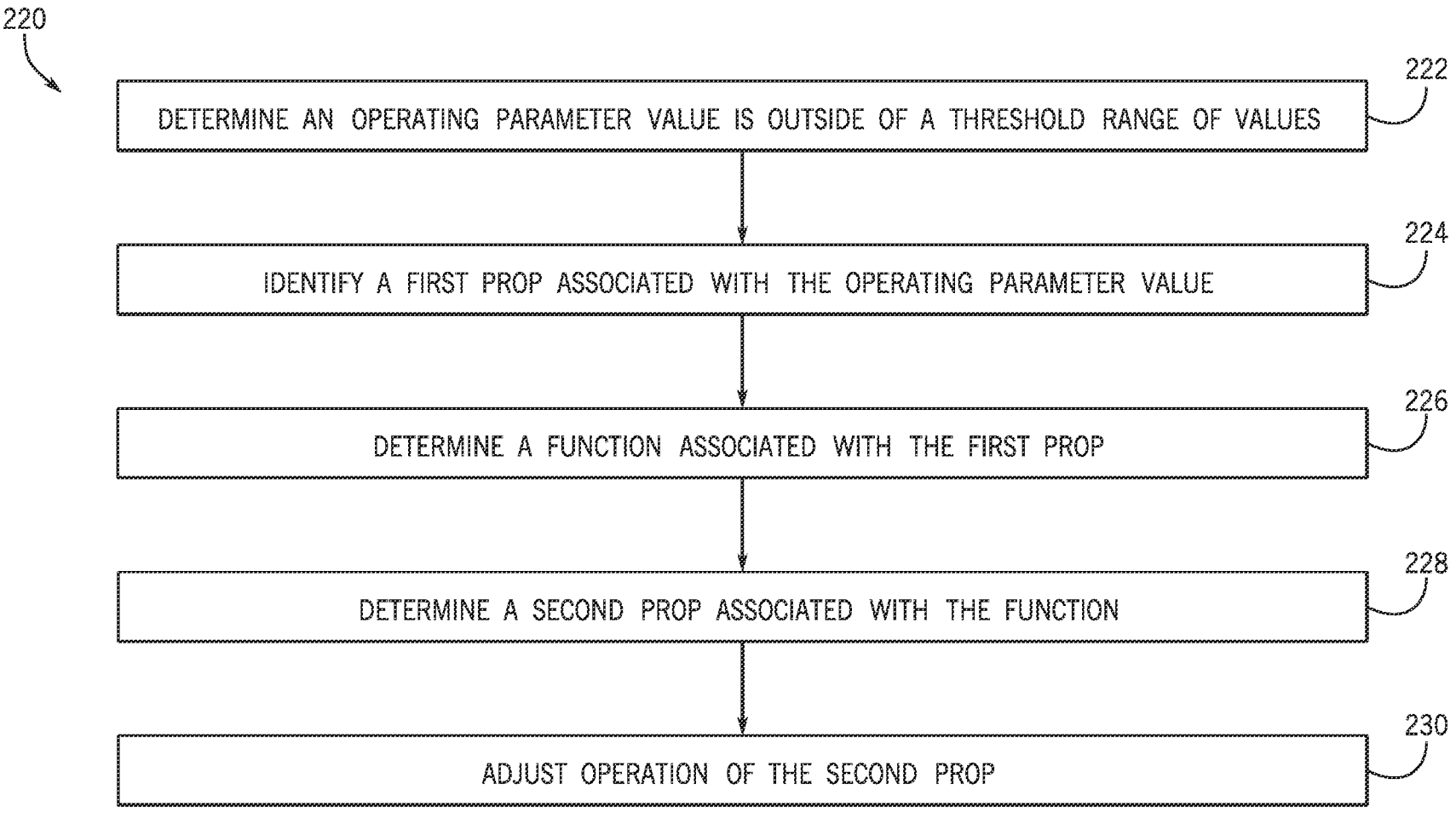
FIG. 5 is a flowchart of a method for adjusting operation of a prop based on operating parameter values, in accordance with an aspect of the present disclosure.

FIG. 5 is a flowchart of a method 220 for adjusting operation of a prop of an amusement park system. At block 222, an operating parameter value is determined to be outside of a threshold range of values. For example, as discussed herein, multiple operating parameter values may be compared to respective, corresponding threshold ranges of values, and one of the operating parameter values may be determined to be outside of its corresponding threshold range of values.

At block 224, a first prop associated with the operating parameter value may be identified. That is, a particular prop that is operating undesirably may be determined based on the operating parameter value. For example, in response to determining that an arrangement of a boundary is outside of a threshold range of values, the prop associated with the boundary may be identified. In response to determining an amount of lighting is below a threshold amount of lighting, a particular light emitter may be identified.

At block 226, a function associated with the first prop is determined. By way of example, each prop may be associated with one or more functions, such as a near contact (e.g., near collision) condition, a lighting effect, an audio effect, and so forth. The operating parameter value being outside of the threshold range of values may indicate that one of the functions of the prop is not desirable. For a prop associated with more than one function, the relevant function(s) may also be identified based on the operating parameter value being outside of the threshold range of values. As an example, for a prop configured to move to provide a near contact condition and also configured to emit light to provide a lighting effect, an operating parameter value associated with positioning of the prop being outside of its threshold range of values may indicate the prop may not be desirably providing the near contact condition. However, the operating parameter value associated with the light emitted by the prop may be within its threshold range of values and may therefore indicate the prop is desirably providing lighting.

At block 228, a second prop associated with the function may be determined. That is, the second prop may also provide the same function as that typically provided by the first prop. For example, another prop configured to move and provide a near contact condition, another light emitter configured to output light, and/or another audio emitter configured to output audio may be detected. At block 230, operation of the second prop may be adjusted. That is, the operation of the second prop may be adjusted to provide the function, thereby compensating for a reduction or lack of the function provided by the first prop, as indicated by the operating parameter value being outside of the threshold range of values. In this manner, even though the first prop may not properly operate to perform its associated function, operation of the second prop may nonetheless cause that associated function to be performed to entertain guests.

By way of example, the first prop may be associated with a near contact condition with respect to a ride vehicle and may typically move to within a threshold distance of the ride vehicle. However, the operating parameter value being outside of the threshold range of values may indicate that the first prop can no longer move within the threshold distance of the ride vehicle and therefore cannot adequately provide the near contact condition. In response, movement of the second prop may be adjusted to provide the near contact condition instead. In an embodiment, the first prop may be configured to provide the near contact condition to a first part (e.g., a first side) of the ride vehicle, and the second prop may be configured to provide the near contact condition to a second part (e.g., a second side), different from the first part, of the ride vehicle. In an additional or alternative embodiment, the first prop and the second prop may be configured to provide the near contact condition to a common part of the ride vehicle.

In an embodiment, instead of providing the associated function using real world objects (e.g., physical props), digital objects may be used. For instance, imagery may be presented to provide the associated function. As an example, the imagery may provide an appearance that a real world object is moving to create the near contact condition. As another example, the imagery may provide an amount of illumination for lighting and/or may provide an appearance of light. In this manner, the associated functions may continue to be performed using a combination of real world objects and digital objects.

Figure 6:
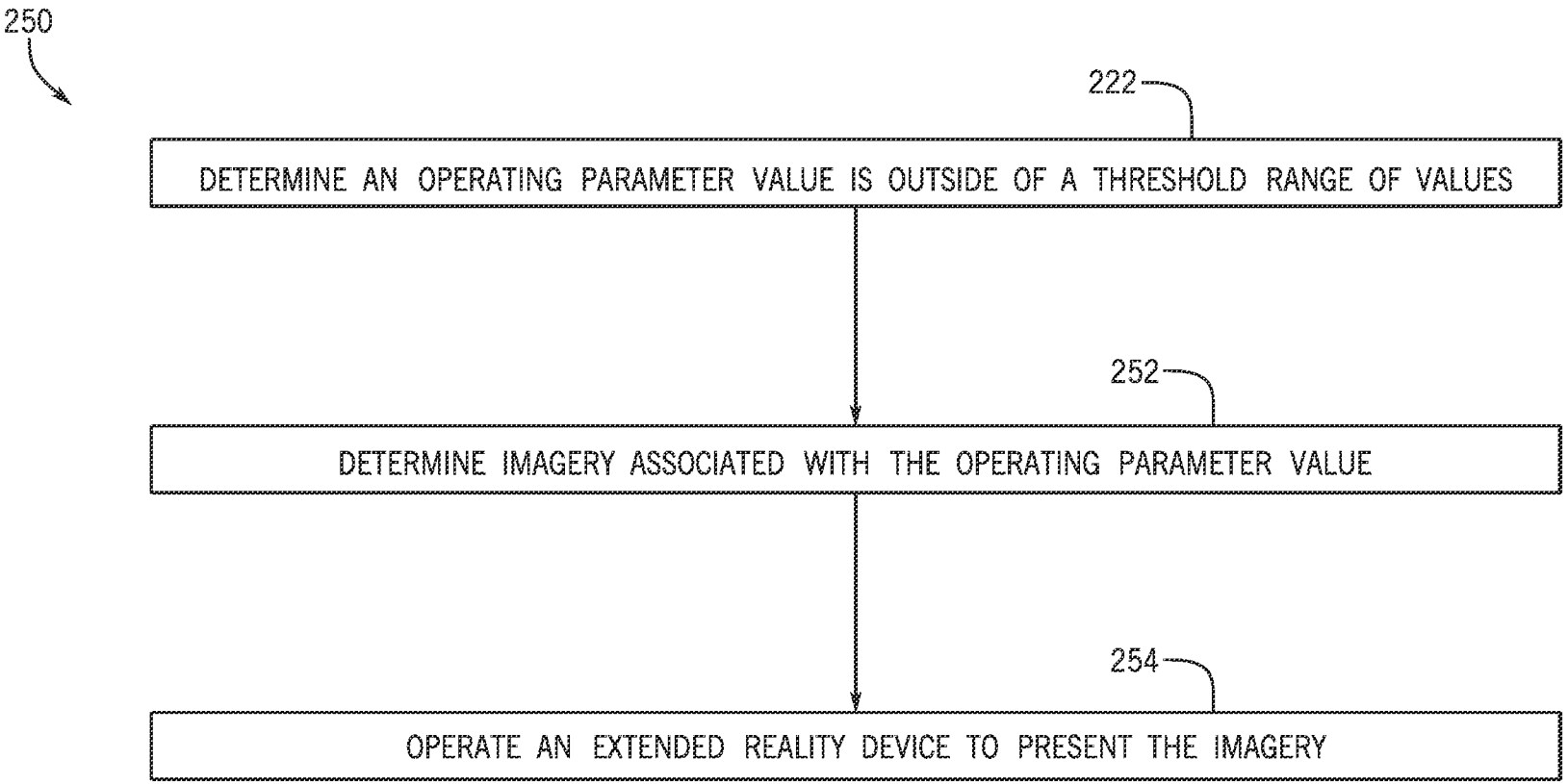
FIG. 6 is a flowchart of a method for adjusting operation of an extended reality device based on operating parameter values, in accordance with an aspect of the present disclosure.

FIG. 6 is a flowchart of an embodiment of a method 250 for operating an extended reality device to present imagery. At block 222, an operating parameter value is determined to be outside of a threshold range of values by using the techniques described above. At block 252, imagery associated with the operating parameter value that is outside of the threshold range of values may be determined. For example, the operating parameter value being outside of the threshold range of values may indicate a function that is not adequately being performed. The imagery may be determined based on the imagery being associated with such a function. In this manner, the imagery may compensate for a reduction or lack of performance of the function. At block 254, the secondary mode may be implemented to cause the extended reality device to present the imagery.

For instance, as described above, the imagery may be associated with providing a near contact condition and/or a lighting effect. Additionally or alternatively, the operating parameter value may indicate a particular prop, and the imagery may appear to interact with the particular prop. As an example, the operating parameter value may indicate an operating status of the particular prop, such as that a subset of light emitters of the prop may not be emitting light as desired, and the extended reality device may present imagery that interacts with the particular prop at the operating status, such as by providing commentary that the subset of light emitters are not desirably emitting light. In other words, the imagery presented by the extended reality device may appear to address the operating status (e.g., the operating parameter value being outside of the threshold range of values) of the particular prop to provide a more realistic portrayal of the imagery. In this manner, the operating status of the prop may be interwoven into the operation of the extended reality device, such as into a story, narrative, or dialogue provided by the extended reality device. In a further embodiment, the imagery may replace at least a portion of the particular prop. For instance, the operating parameter may indicate that a part of the prop may not be visible to the guests (e.g., the part of the prop is not positioned at a target location). As a result, the imagery may be presented (e.g., to appear to be at the target location of the part of the prop) and replace the real world part of the prop that is not seen by the guests. By way of example, in response to determining a real world object representative of a bird is not positioned at a visible location, a digital object representative of the bird may be presented instead.

The operating parameter value being outside of the threshold range of values may additionally, or alternatively, indicate a particular maintenance operation to be performed with respect to the amusement park system. For example, the maintenance operation may be associated with a particular prop to be repaired, replaced, and/or inspected. In such a maintenance operation, a user, such as a technician, may be visible to the guests during continued operation of the amusement park system. For this reason, the imagery presented by the extended reality device may appear to interact with the user. For example, the imagery may appear to acknowledge the presence of the user and/or the maintenance operation being performed. To this end, the maintenance operation, including an associated prop and/or an associated quantity of users, may be determined based on the operating parameter value being outside of the threshold range of values, imagery may be determined based on the determined maintenance operation, and the extended reality device may be operated to present such imagery. In this manner, the maintenance operation and/or the user may appear to be a part of the immersive experience provided to the guests, thereby enabling the amusement park system to continue entertaining the guests while the maintenance operation is ongoing.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A controller for an amusement park attraction system, the controller comprising:

processing circuitry; and memory comprising instructions that, when executed by the processing circuitry, are configured to cause the processing circuitry to perform operations comprising:

operating the amusement park attraction system in a primary mode;

receiving a plurality of operating parameter values of the amusement park attraction system during operation of the amusement park attraction system in the primary mode, wherein an operating parameter value of the plurality of operating parameter values comprises a distance between a first boundary associated with a first object and a second boundary associated with a second object, determining the distance is outside of a corresponding threshold range of values associated with the operating parameter value in the primary mode;

transitioning operation of the amusement park attraction system from the primary mode to a secondary mode of a plurality of secondary modes in response to determining the operating parameter value is outside of the corresponding threshold range of values in the primary mode, wherein operating the amusement park attraction system in the secondary mode comprises adjusting operation of one or both of the first object or the second object;

determining a corresponding threshold ranges of values associated with the secondary mode in response to transitioning the operation of the amusement park attraction system from the primary mode to the secondary mode;

receiving an updated plurality of operating parameter values during the operation of the amusement park attraction system in the secondary mode; and comparing the updated plurality of operating parameter values to the corresponding threshold ranges of values associated with the secondary mode.

2. The controller of claim 1, wherein the memory stores a model that associates the plurality of secondary modes to respective, corresponding operating parameter values of the plurality of operating parameter values that are outside of the respective, corresponding threshold ranges of values, and the instructions, when executed by the processing circuitry, are configured to cause the processing circuitry to perform operations comprising:

selecting the secondary mode from the plurality of secondary modes based on the secondary mode being associated with the operating parameter value that is outside of the corresponding threshold range of values in accordance to the model; and transitioning the operation of the amusement park attraction system from the primary mode to the secondary mode upon selecting the secondary mode from the plurality of secondary modes.

3. The controller of claim 1, wherein the instructions, when executed by the processing circuitry, are configured to cause the processing circuitry to perform operations comprising:

determining an additional operating parameter value of the plurality of operating parameter values is outside of an additional corresponding threshold range of values in the secondary mode; and transitioning the operation of the amusement park attraction system from the secondary mode to an additional secondary mode in response to determining the additional operating parameter value is outside of the additional corresponding threshold range of values in the secondary mode.

4. The controller of claim 1, wherein the instructions, when executed by the processing circuitry, are configured to cause the processing circuitry to perform operations comprising:

determining the distance is below the threshold range of values; and adjusting movement of the first object to increase the distance, wherein the first object is a ride vehicle.

5. The controller of claim 1, wherein the instructions, when executed by the processing circuitry, are configured to cause the processing circuitry to perform operations comprising:

determining the distance is above the threshold range of values; and adjusting actuation of the first object or the second object in response to determining the distance is above the threshold range of values.

6. The controller of claim 1, wherein the instructions, when executed by the processing circuitry, are configured to cause the processing circuitry to perform operations comprising:

determining an absence of receipt of an additional operating parameter value of the plurality of operating parameter values; and transitioning the operation of the amusement park attraction system from the primary mode to an additional secondary mode of the plurality of secondary modes in response to determining the absence of the receipt of the additional operating parameter value.

7. A non-transitory computer-readable medium comprising instructions that, when executed by processing circuitry, are configured to cause the processing circuitry to perform operations comprising:

receiving a plurality of operating parameter values of an amusement park system;

operating the amusement park system in a primary mode in response to determining each operating parameter value of the plurality of operating parameter values is within a respective, corresponding threshold range of values;

determining an operating parameter value of the plurality of operating parameter values is outside of a corresponding threshold range of values;

identifying a maintenance operation associated with the operating parameter value being outside of the corresponding threshold range of values;

selecting a secondary mode from a plurality of secondary modes based on the secondary mode being associated with the operating parameter value that is outside of the corresponding threshold range of values; and operating the amusement park system in the secondary mode to present imagery based on the maintenance operation.

8. The non-transitory computer-readable medium of claim 7, wherein the instructions, when executed by the processing circuitry, are configured to cause the processing circuitry to perform operations comprising:

identifying a prop of the amusement park system based on the maintenance operation; and operating the amusement park system in the secondary mode to present the imagery based on the prop.

9. The non-transitory computer-readable medium of claim 7, wherein the operating parameter value indicates an amount of light provided by a light emitter of the amusement park system, and the instructions, when executed by the processing circuitry, are configured to cause the processing circuitry to perform operations comprising:

determining the amount of the light provided by the light emitter is below a threshold level; and operating the amusement park system in the secondary mode to present the imagery to adjust the amount of the light.

10. The non-transitory computer-readable medium of claim 7, wherein the instructions, when executed by the processing circuitry, are configured to cause the processing circuitry to perform operations comprising:

identifying a first prop associated with the operating parameter value that is outside of the corresponding threshold range of values;

determining a function associated with the first prop;

determining a second prop associated with the function; and operating the amusement park system in the secondary mode to adjust operation of the second prop.

11. The non-transitory computer-readable medium of claim 10, wherein the function comprises a near contact condition with a ride vehicle, and the instructions, when executed by the processing circuitry, are configured to cause the processing circuitry to perform operations comprising:

determining the operating parameter value being outside of the corresponding threshold range of values indicates an absence of the near contact condition between the first prop and the ride vehicle; and operating the amusement park system in the secondary mode to adjust movement of the second prop to within a threshold distance of the ride vehicle to provide an additional near contact condition between the second prop and the ride vehicle.

12. The non-transitory computer-readable medium of claim 7, wherein the instructions, when executed by the processing circuitry, are configured to cause the processing circuitry to perform operations comprising:

determining fatigue of different portions of a prop of the amusement park system based on the plurality of operating parameter values; and determining a boundary of the prop based on the fatigue of the different portions.

13. The non-transitory computer-readable medium of claim 12, wherein the operating parameter value comprises a set of coordinate points of the boundary of the prop in a coordinate system representing a space of the amusement park system, and the corresponding threshold range of values comprises a corresponding threshold range of coordinate points in the coordinate system.

14. An amusement park system, comprising:

a prop;

an actuator configured to drive movement of the prop; and a controller communicatively coupled to the actuator, wherein the controller is configured to perform operations comprising:

receiving a plurality of operating parameter values of the amusement park system;

determining an operating parameter value of the plurality of operating parameter values is outside of a threshold range of values;

determining the prop is associated with the operating parameter value that is outside of the threshold range of values;

operating the amusement park system in a secondary mode of a plurality of secondary modes, instead of in a primary mode, in response to determining the operating parameter value is outside of the threshold range of values;

determining an absence of receipt of an additional operating parameter value of the plurality of operating parameter values; and transitioning the operation of the amusement park system from the primary mode to an additional secondary mode of the plurality of secondary modes in response to determining the absence of the receipt of the additional operating parameter value.

15. The amusement park system of claim 14, comprising a ride vehicle, wherein the operating parameter value comprises a distance between the prop and the ride vehicle, the threshold range of values comprises a threshold range of distances, and the controller is configured to perform operations comprising:

determining the distance is outside of the threshold range of values; and operating the amusement park system in the secondary mode to adjust the distance toward the threshold range of values.

16. The amusement park system of claim 15, wherein the prop comprises:

a first component;

a second component configured to move relative to the first component; and a third component configured to move relative to the second component;

wherein the actuator comprises a first actuator configured to drive relative movement between the second component and the first component, the amusement park system comprises a second actuator configured to drive relative movement between the third component and the second component, and the controller is configured to perform operations comprising:

determining that one of the relative movement between the first component and the second component or the relative movement between the second component and the third component causes the distance to be outside of the threshold range of distances; and operating the amusement park system in the secondary mode to adjust the other of the relative movement between the first component and the second component or the relative movement between the second component and the third component to adjust the distance toward the threshold range of distances.

17. The amusement park system of claim 14, comprising an additional prop and an additional actuator configured to drive movement of the additional prop, wherein the controller is communicatively coupled to the additional actuator, the operating parameter value comprises a positioning of the prop, the threshold range of values comprises a threshold range of positionings around a target positioning of the prop, and the controller is configured to perform operations comprising:

determining the positioning of the prop is outside of the threshold range of positionings; and operating the amusement park system in the secondary mode to adjust the positioning of the additional prop toward the target positioning of the prop.

18. The amusement park system of claim 14, comprising a plurality of sensors, wherein the controller is configured to receive the plurality of operating parameter values from the plurality of sensors, wherein the plurality of sensors comprises an optical sensor, a position sensor, a vibration sensor, a force sensor, a deformation sensor, a pressure sensor, a power sensor, or any combination thereof.

* * * * *